US006554584B2

(12) United States Patent
Takura et al.

(10) Patent No.: US 6,554,584 B2
(45) Date of Patent: Apr. 29, 2003

(54) INLINE TYPE PUMP

(75) Inventors: Toshiyasu Takura, Hino (JP); Yoshifumi Tanabe, Yokkamachi (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 110 days.

(21) Appl. No.: 09/771,974

(22) Filed: Jan. 30, 2001

(65) Prior Publication Data

US 2001/0051097 A1 Dec. 13, 2001

(30) Foreign Application Priority Data

| | | |
|---|---|---|
| Jan. 31, 2000 | (JP) | 2000-022836 |
| Feb. 1, 2000 | (JP) | 2000-023614 |
| Jan. 17, 2001 | (JP) | 2001-008375 |
| Jan. 22, 2001 | (JP) | 2001-013809 |

(51) Int. Cl.[7] ..... F04B 17/00; F04B 35/00
(52) U.S. Cl. ..... 417/355; 241/46.11
(58) Field of Search ..... 417/355, 350, 417/356, 366, 415; 241/46.11

(56) References Cited

U.S. PATENT DOCUMENTS

| | | | | |
|---|---|---|---|---|
| 3,874,823 A | * | 4/1975 | Savikurki | 417/356 |
| 3,972,653 A | * | 8/1976 | Travis et al. | 417/356 |
| 4,408,966 A | * | 10/1983 | Marayama | 417/356 |
| 4,504,196 A | * | 3/1985 | Lay | 417/355 |
| 5,181,837 A | * | 1/1993 | Niemiec | 417/350 |
| 5,320,501 A | * | 6/1994 | Langosch et al. | 417/415 |
| 5,527,159 A | | 6/1996 | Bozeman, Jr. et al. | |
| 5,674,056 A | * | 10/1997 | Yamamoto et al. | 417/366 |
| 6,010,086 A | * | 1/2000 | Earle et al. | 241/46.11 |
| 6,100,618 A | | 8/2000 | Schoeb et al. | |
| 6,109,887 A | | 8/2000 | Takura et al. | |

FOREIGN PATENT DOCUMENTS

| | | |
|---|---|---|
| JP | 10-246193 | 9/1998 |
| JP | 11-503210 | 3/1999 |
| JP | 11-230088 | 8/1999 |
| WO | WO 96/31934 | 10/1996 |

OTHER PUBLICATIONS

U.S. patent application Ser. No. 09/777,436, filed Feb. 6, 2001, pending.
U.S. patent application Ser. No. 09/773,344, filed Jan. 31, 2001, pending.
U.S. patent application Ser. No. 09/771,974, filed Jan. 30, 2001, pending.
U.S. patent application Ser. No. 10/133,417, filed Apr. 29, 2002, pending.

* cited by examiner

*Primary Examiner*—Teresa Walberg
*Assistant Examiner*—Leonid Fastovsky
(74) *Attorney, Agent, or Firm*—Oblon, Spivak, McClelland, Maier & Neustadt, P.C.

(57) ABSTRACT

An inline type pump in which a rotor having an axial flow vane is arranged inside the cylindrical stator. The fluid is discharged from the discharging port after a rotating kinetic energy of the fluid transferred by the axial flow vane toward the discharging port is changed into a static pressure energy at the pressure chamber. With such an arrangement as above, it is possible to increase a fluid supplying efficiency after satisfying a small-sized structure and further it is possible to increase an output of the pump as well as its efficiency.

13 Claims, 13 Drawing Sheets

INLINE TYPE PUMP

BACKGROUND OF THE INVENTION

1. Field of the Invention

This invention relates to an inline type pump in which a flow passage is formed within a motor having a stator and a rotor as its main component parts.

2. Description of the Prior Art

As already described in the gazette of Japanese Patent Laid-Open No. Hei 10-246193 or the gazette of Japanese Patent Laid-Open No. Hei 1-230088, for example, this kind of inline type pump is constructed such that the rotor installed inside the stator has a function of an axial flow vane by forming both some protrusions and some recesses at its outer circumference, and the rotor is rotated to cause fluid sucked at a suction port of one end side of the rotor to be discharged out of a discharging port at the other end of the rotor.

In such an inline type pump as described above, a rotational kinetic energy is given to fluid by the axial flow vane, and the kinetic energy is lost as a frictional loss at the wall of an inner circumference or the discharging port or an eddy loss caused by turbulent flow while the kinetic energy is not converted into a static pressure energy, thereafter the energy is transferred, so that the pump shows a poor efficiency.

In addition, since the fluid always flows only in one axial direction of the rotor, a reacting pressure of the fluid may act against the rotor as a thrust load and it shows a problem that a life of the bearing becomes quite short.

SUMMARY OF THE INVENTION

It is an object of the present invention to provide an inline type pump in which a fluid supplying efficiency can be increased while a small-sized structure is satisfactorily attained.

The present invention is applied to an inline type pump in which the rotor having an axial flow vane for axially feeding out fluid sucked from the suction port toward the discharging port is rotatably arranged inside the cylindrical stator. There is provided a pressure chamber in which a rotational kinetic energy of the fluid sent toward the discharging port is converted into a static pressure energy by the axial flow vane of the rotor, and when the rotor is rotated, the fluid sucked from the suction port is transferred to the pressure chamber by the axial flow vane, the rotational kinetic energy is converted into the static pressure energy at this pressure chamber and then the fluid is discharged out of the discharging port.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

Figure 1:
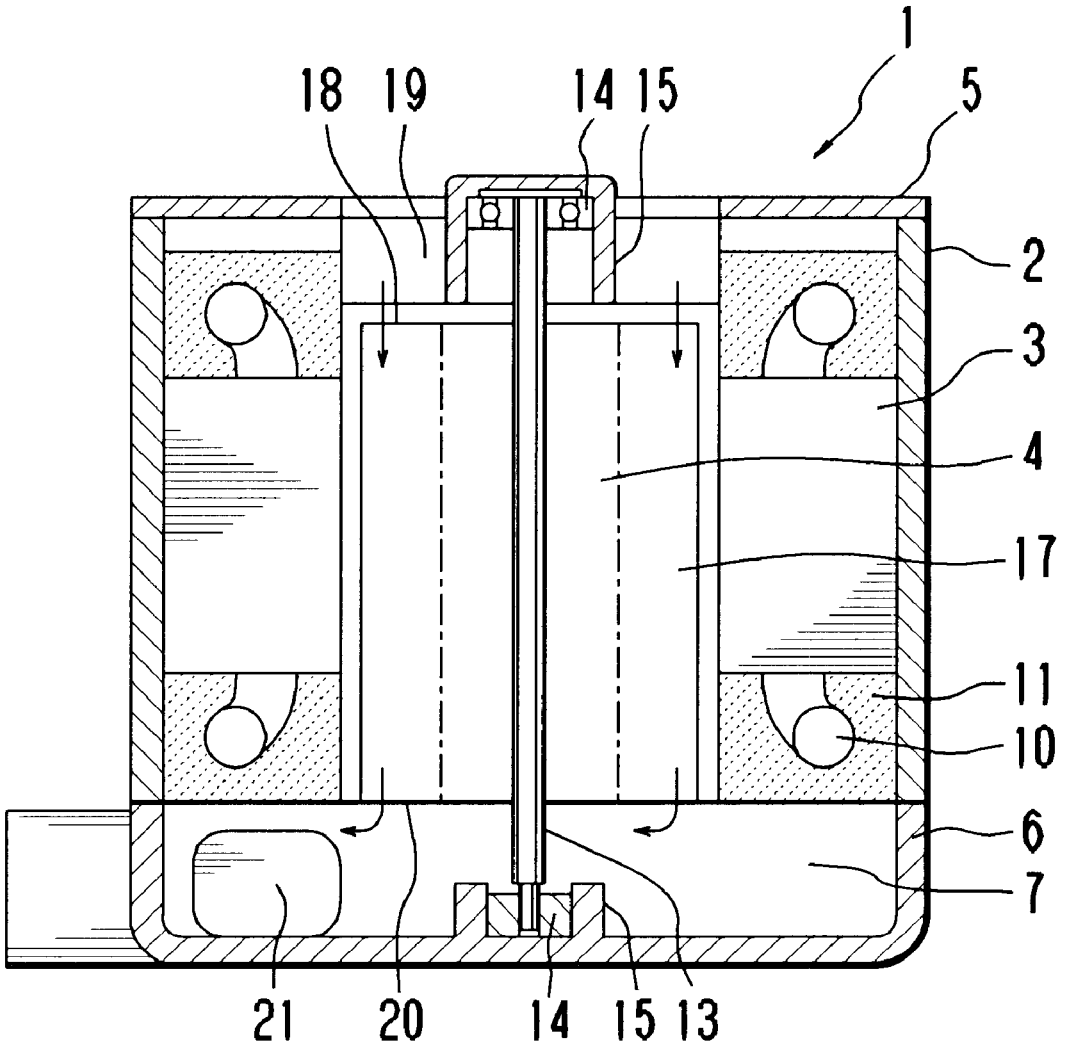
FIG. 1 is a sectional view for showing an entire inline type pump in a first preferred embodiment of the present invention.
Figure 2:
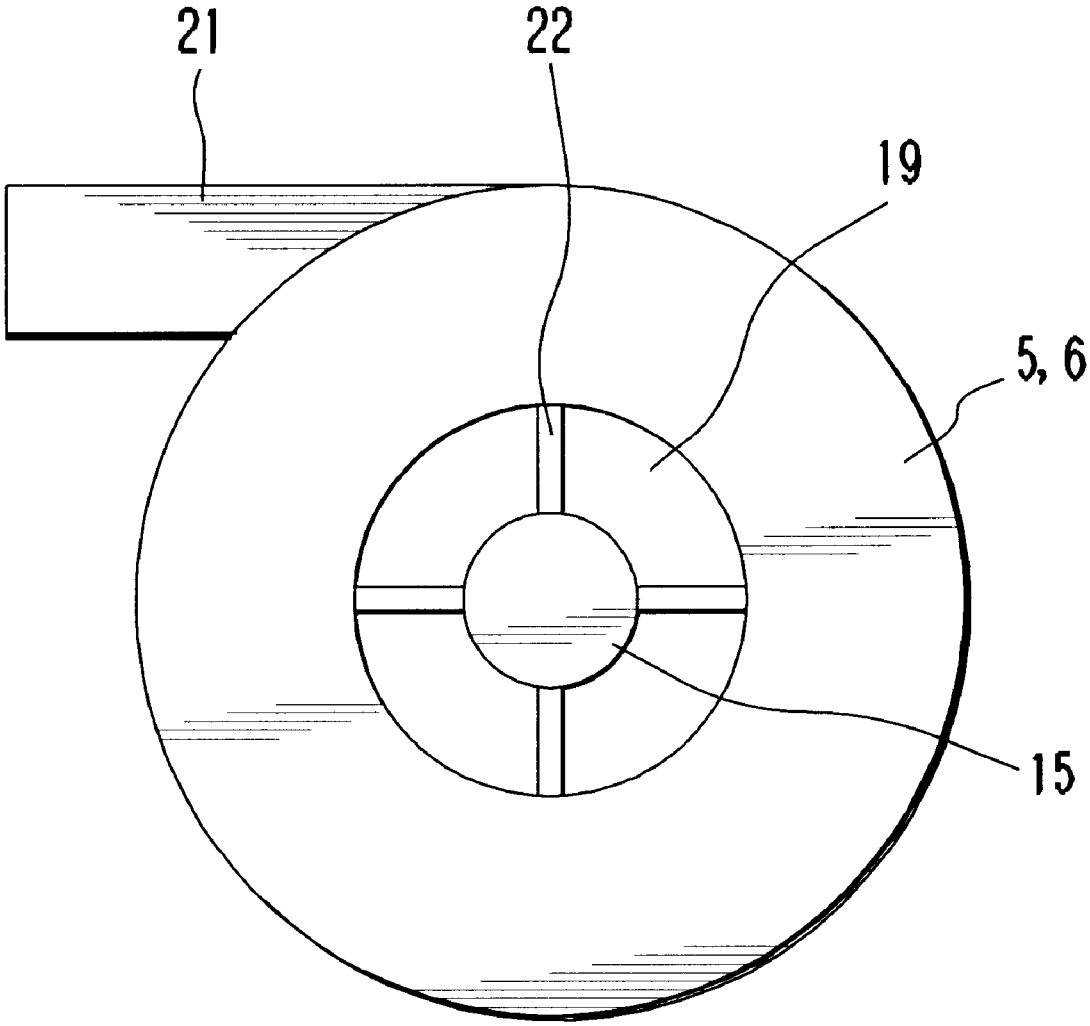
FIG. 2 is a top plan view in the first preferred embodiment.

Referring now to the drawings, the preferred embodiments of the present invention will be described as follows.

[First Preferred Embodiment]

At first, referring to FIGS. 1 to 5, a first preferred embodiment of the present invention will be described.

As shown in FIGS. 1 to 5, an inline type pump 1 is comprised of a stator 3 constituting the major component section of the motor 2, frames 5, 6 rotatably supporting a rotor 4 at an inner diameter of the stator 3, and a pressure chamber 7.

The stator 3 is constituted by a stator core 9 having six magnetic poles 8 each having the same shape arranged in a pitch of 60° at its inner circumference, and coils 10 at each of the magnetic poles 8 of the stator core 9. The stator core 9 is cylindrical and a plurality of silicon steel plates are axially laminated. The coils 10 are wound in a counter-clockwise direction as phase A, phase B, phase C, phase A, phase B and phase C in order at each of the magnetic poles 8 of the stator core 9, respectively. Then, each of the phases is wired by a Y-connecting line or a Δ-connecting line, three lead wires are drawn out, three-phase alternating current having different phase of 120° is applied to each of the lead lines, and their frequencies are changed to enable a rotational speed to be changed.

Inner part including the entire inner circumferential surface of the stator core 9 of the stator 3 and the coils 10 is processed by molding insulating resin 11 such as polyester and the like for water-proof state.

Figure 3:
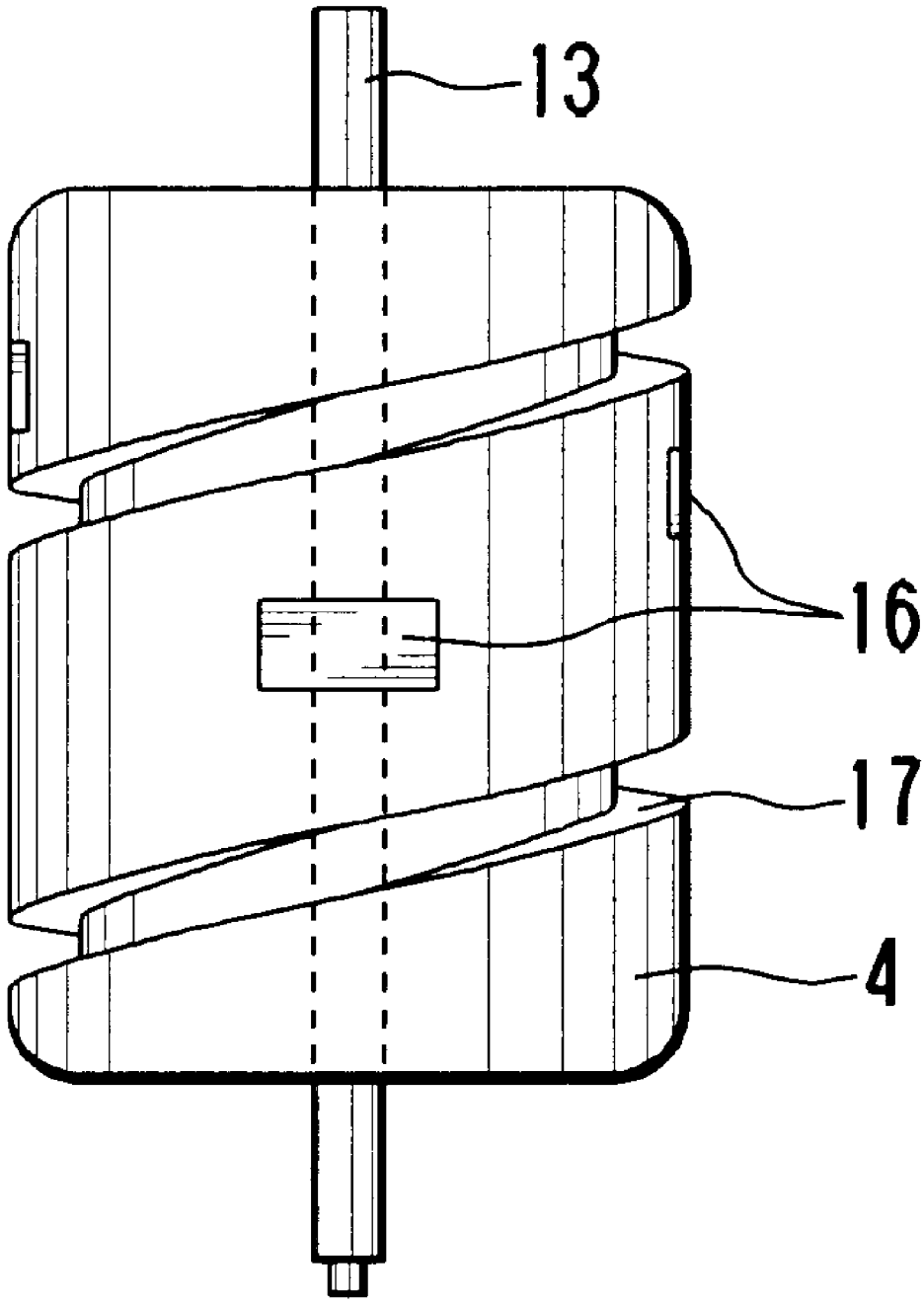
FIG. 3 is a front elevational view for showing a rotor of the first preferred embodiment.

As shown in FIG. 3, the rotor 4 is comprised of a rotor core 12 and a rotating shaft 13 for holding the rotor core 12 and the like. The rotating shaft 13 is rotatably supported at bearing supporting sections 15, 15 of frames 5, 6 through the bearings 14, 14.

The rotor core 12 is made such that four salient poles 16 magnetized to have different polarities alternatively in a circumferential direction are formed into a cylindrical shape and a helical recess 17 is formed at an outer circumferential part of each of the salient poles. An inner diameter of the stator 3 and the recess 17 forms a flow passage of the fluid in an axial direction. The helical recess 17 may act to perform the function of the axial flow vane. Width, depth, inclination angle and helical pitch and the like of the helical recess 17 are selected according to a desired performance of the pump. That is, the helical pitch can be selected in a range of one thread to N-threads in response to a performance. Shape of the recess can be adapted for all kinds of shape such as V-groove, U-groove and the like.

In turn, one frame 5 is formed with a suction part 19 for sucking fluid between the frame 5 and one end 18 of the rotor 4, and the other frame 6 forms a discharging port 21 discharging the fluid through a pressure chamber 7 between the frame 5 and the other end part 20 of the rotor 4. The suction port 19 is divided into four segments by fixed guide vanes 22 bridging the frame 5 with the bearing supporter 15. The pressure chamber 7 has a function of smoothing and decelerating the flow velocity of the rotating fluid. The pressure chamber 7 is arranged at the other end of the rotor 4. Then, the bearing supporters 15, 15 are arranged more inside circumferentially than a diameter of bottom part of the recess 17 of the rotor 4.

Figure 4A:
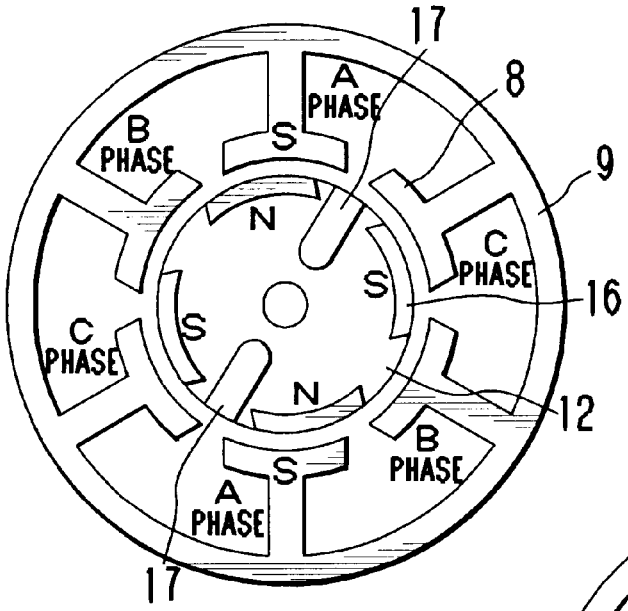
FIG. 4 is a schematic view for illustrating a rotating operation of the rotor of the first preferred embodiment.
Figure 4B:
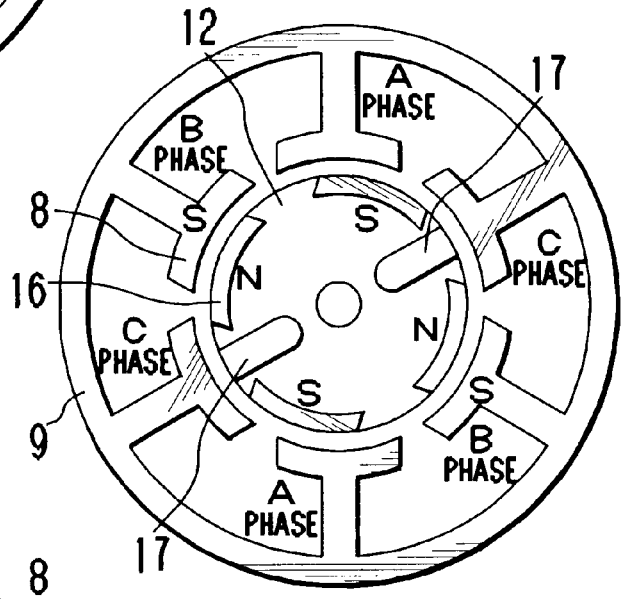
Figure 4C:
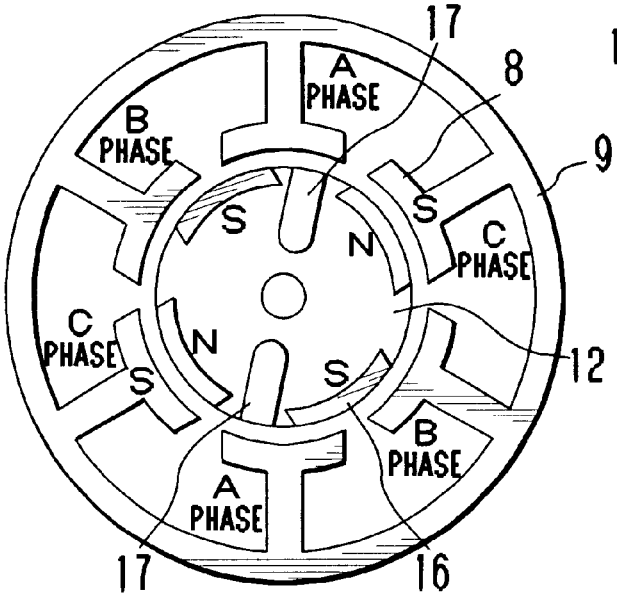

Then, referring to FIGS. 4 and 5, a principle of operation of this inline type pump will be described. At first, as the A-phase coil of the stator core 9 is excited, the magnetic pole 8 of this A-phase becomes S-pole, and as shown at (a) in FIG. 4, a salient pole of N-pole of the rotor core 12 comes to the position of the A-magnetic pole and is stabilized. Then, as the B-phase coil is excited, the magnetic pole 8 of this B-phase becomes an S-pole, and as shown in (b) of FIG. 4, the salient pole of N-pole in the rotor core 12 comes to the position of the magnetic pole 8 of the B-phase and is stabilized. Then, as the C-phase coil is excited, the magnetic pole 8 of the C-phase becomes an S-pole, and as shown at (c) of FIG. 4, the salient pole of the N-pole in the rotor core 12 comes to the position of the magnetic pole 8 of the C-phase and is stabilized.

Figure 5A:
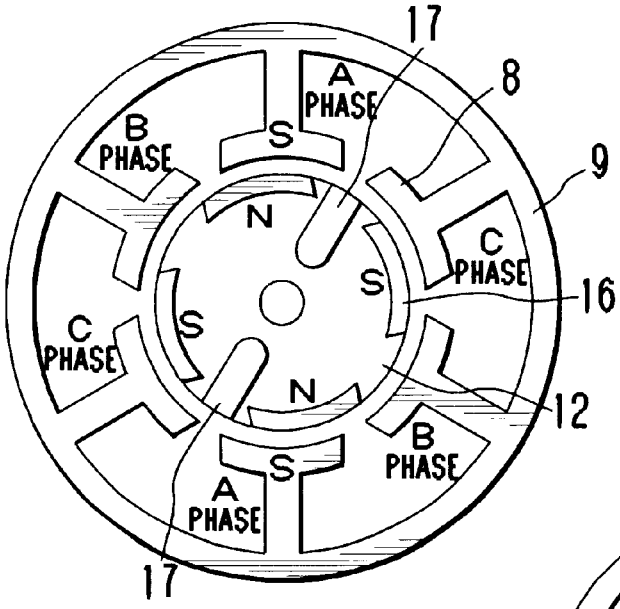
FIG. 5 is schematic view for illustrating a rotating operation of the rotor of the first preferred embodiment.
Figure 5B:
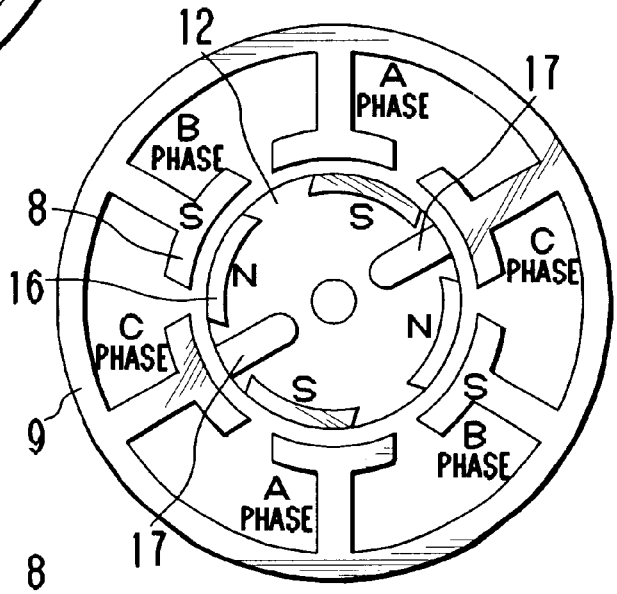
Figure 5C:
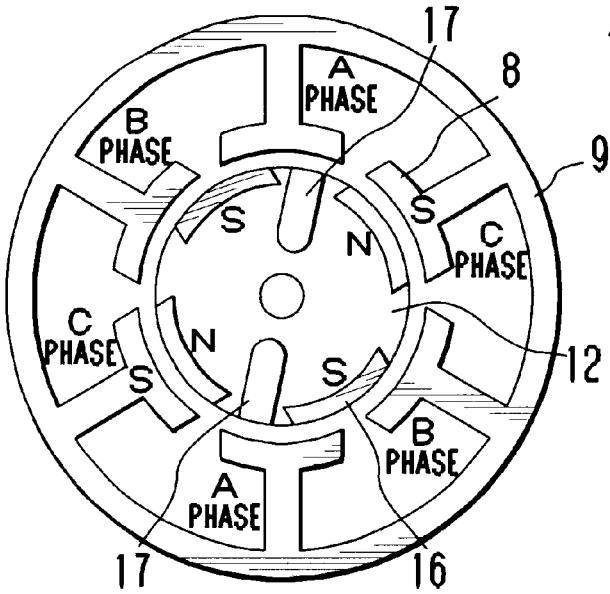

Then, as the A-phase coil is excited again, the magnetic pole 8 of the A-phase becomes the S-pole, and as shown at (a) of FIG. 5, the salient pole of the N-pole in the rotor core 12 comes to the position of the magnetic pole 8 of the A-phase and is stabilized. Then, as the B-phase coil is excited, the magnetic pole 8 of this B-phase becomes an S-pole, and as shown in (b) of FIG. 5, the salient pole of N-pole in the rotor core 12 comes to the position of the magnetic pole 8 of the B-phase and is stabilized. Then, as the C-phase coil is excited, magnetic pole 8 of the C-phase become the S-pole, and as shown at (c) of FIG. 5, the salient pole of the N-pole in the rotor core 12 comes to the position of the magnetic pole 8 of the C-phase and is stabilized. Then, as the A-phase coil is excited further again, magnetic pole 8 of the A-phase become the S-pole, it returns to the state shown at (a) of FIG. 4, and the rotor is just rotated once. In this way, the rotor core 12 is rotated by changing over the excited phases in sequence and the changing-over speed is made variable to cause the motor speed to be changed.

In the configuration shown in FIG. 1, as the rotor 4 is rotated, the axial flow vane composed of helical recess at the outer circumference of the rotor 4 is rotated, the fluid flows from the suction part as indicated by an arrow in the figure, the fluid passes through the stator 3 and the helical recess 17 of the rotor 4, and further the fluid passes through the pressure chamber 7 and flows out of the discharging port 21.

In this way, the helical recess 17 axially communicated with the rotating shaft 13 is formed at the outer circumference of the rotor 4, the axial flow vane is formed, so that the fluid accelerated by the axial flow vane with the helical recess 17 of the rotor 4 is circulated. The pressure chamber 7 for changing the kinetic energy into a pressure is arranged at the discharging side of the rotor 4. The fluid discharged from the axial flow vane of the rotor 4 is circulated in the pressure chamber 7 and dispersed at the outer circumference. The flow speed of the discharged flow is decreased more at the outer circumference and its pressure is increased. Although almost of the load at the axial flow vane caused by arrangement of this pressure chamber 7 can be ignored, an inclination angle of the vane in respect to the axial direction has been set to 45 to 70°. As a result, the discharging pressure and the flow rate could be improved by about 50% as compared with that having no pressure chamber 7 at any kinds of axial flow vanes.

Further, since the water-proof processing is carried out by molding the stator 3 with insulation resin 11, it is also possible to use this inline type pump in water. With such an arrangement as above, since it is possible to improve a cooling effect, even if it is set to be small in size, a sufficient thermal radiation can be assured.

[Second Preferred Embodiment]

Then, referring to FIG. 6, a second preferred embodiment of the present invention will be described. The same portions as that of the aforesaid first preferred embodiment are denoted by the same reference symbols and the different portions will be described as follows.

Figure 6:
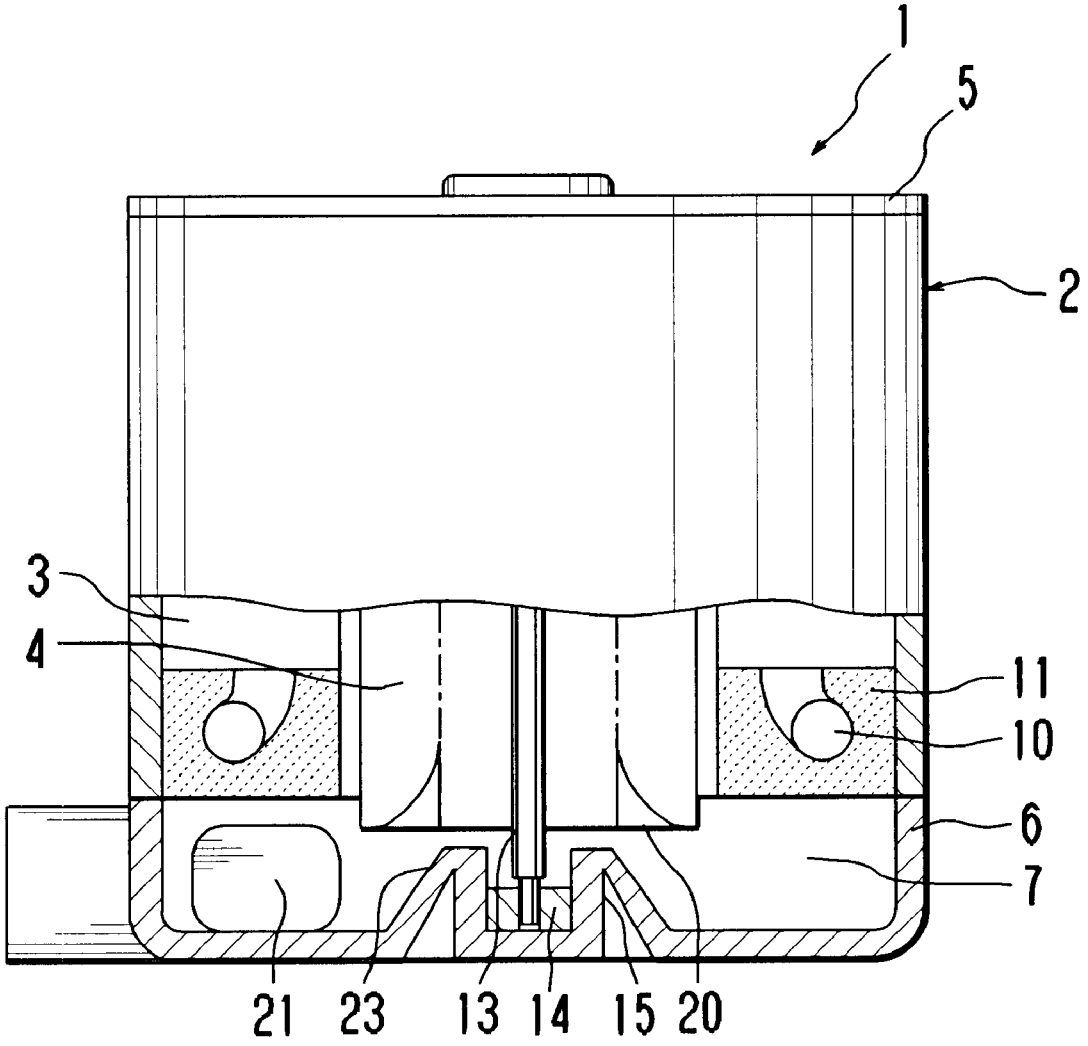
FIG. 6 is a sectional view for showing an entire inline type pump in a second preferred embodiment of the present invention.

As shown in FIG. 6, the other end 20 of the rotor 4 is extended into the pressure chamber 7 and arranged there. Then, the bottom part of the helical recess 17 of the rotor 4 is gradually made shallow, thereby the axial flow component is directed toward the outer circumferential direction. Further, an inclination part 23 acting as a flow rectifying part is arranged at the pressure chamber 7 opposite to the rotor 4, thereby the discharging flow from the axial flow vane prevents generation of turbulent flow caused by striking against the bottom surface of the pressure chamber 7 in a perpendicular direction and a pressure toward the outer circumferential direction can be increased.

[Third Preferred Embodiment]

Figure 7:
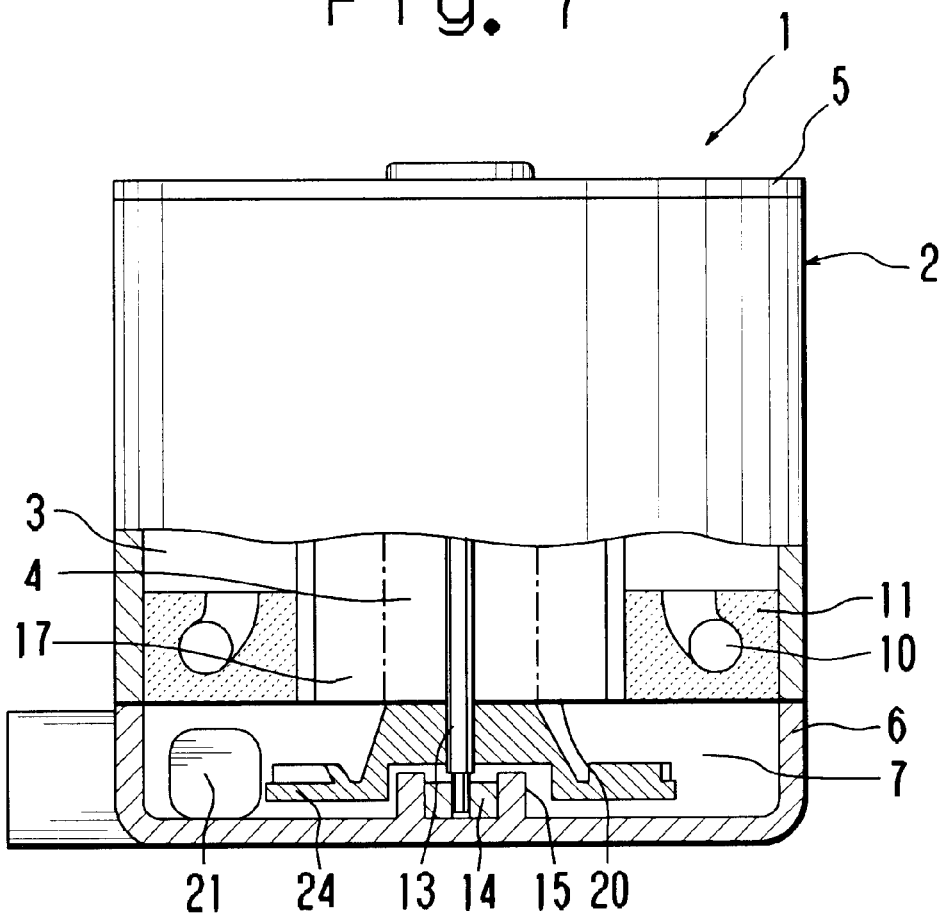
FIG. 7 is a front elevational view for showing an entire inline type pump in a third preferred embodiment of the present invention.
Figure 8:
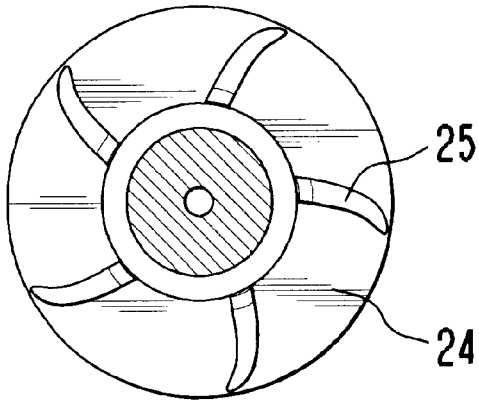
FIG. 8 is a partial sectional view for showing a centrifugal vane of the third preferred embodiment of the present invention.

Referring to FIGS. 7 and 8, a third preferred embodiment of the present invention will be described as follows. The same portions as that of each of the aforesaid preferred embodiments are denoted by the same reference symbols and the different portions will be described as follows.

As shown in FIGS. 7 and 8, a centrifugal vane 24 has some blades 25 inclined in a rotating direction. The centrifugal vane 24 is fixed to the rotating shaft 13 with its side of blades 25 being opposed to the other end 20 of the rotor 4 and the centrifugal vane is arranged within the pressure chamber 7. Since a circulating speed of the fluid within the pumps of the same size is increased, this arrangement becomes effective for increasing a pump output as well as improving a maximum discharging pressure.

In addition, in each of the preferred embodiments, although the system having the rotor of four-pole salient pole structure has been described, it is of course apparent that the present invention is not necessarily restricted to this system.

[Fourth Preferred Embodiment]

Figure 9:
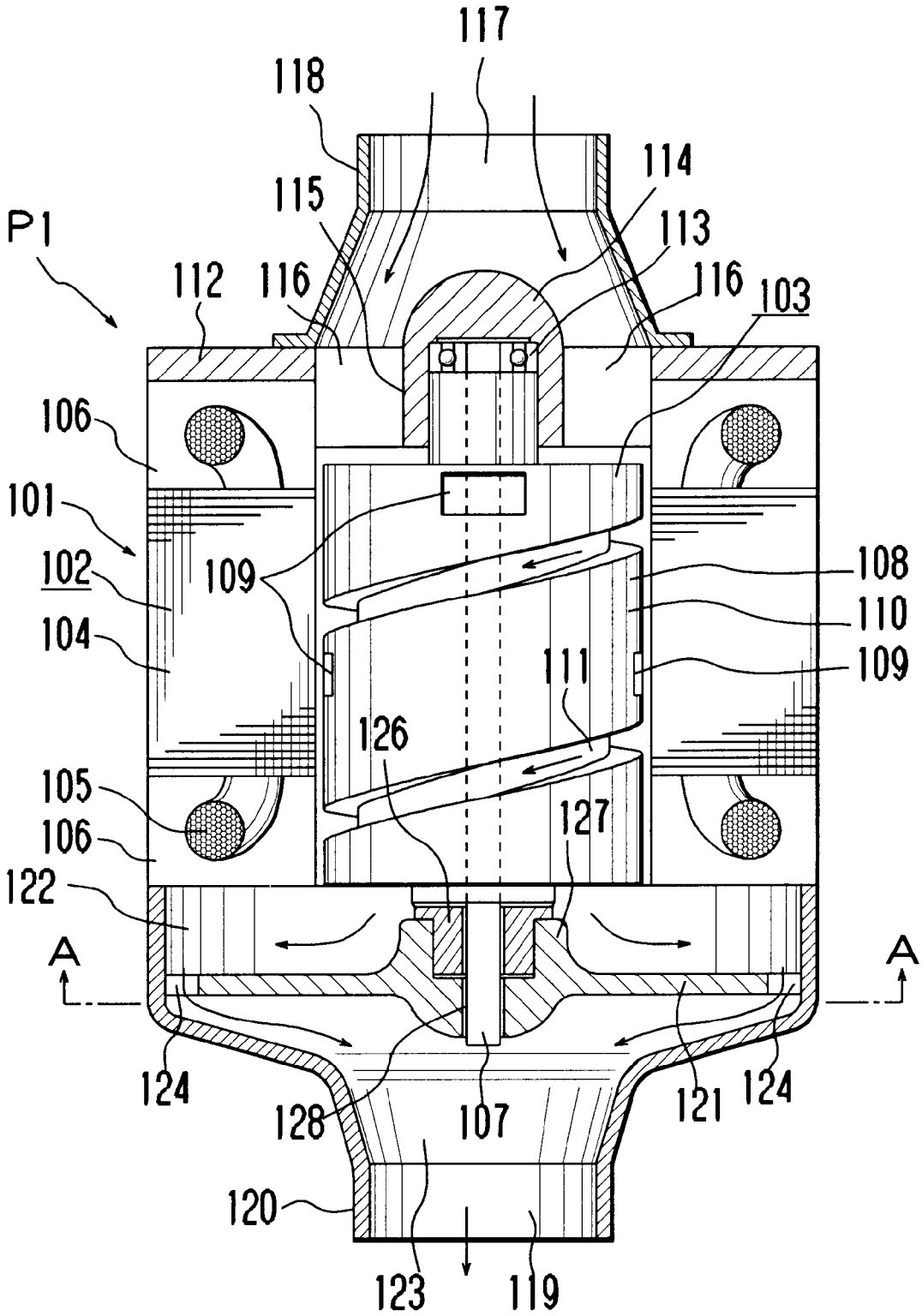
FIG. 9 is a side elevational view in longitudinal section for showing an inline type pump in a fourth preferred embodiment of the present invention.
Figure 10:
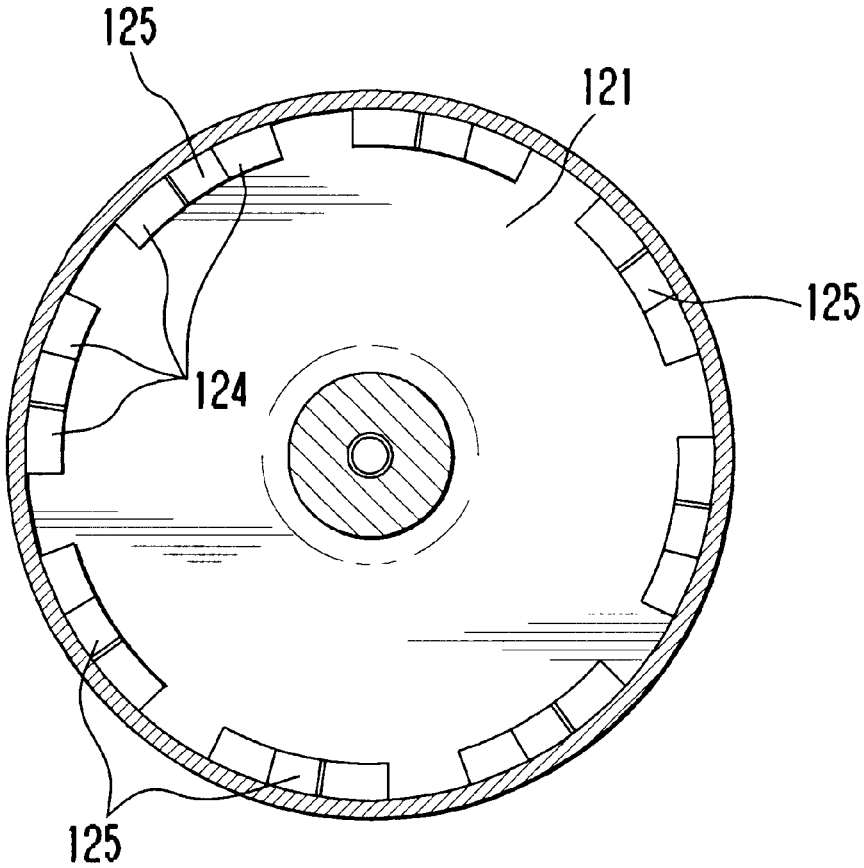
FIG. 10 is a sectional view taken along an arrow line A—A in FIG. 9.
Figure 11:
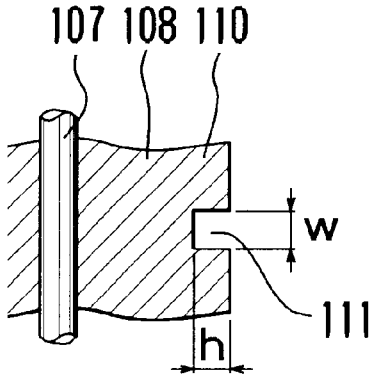
FIG. 11 is a side elevational view in longitudinal section for illustrating a part of a rotor.

Referring to FIGS. 9 to 11, a fourth preferred embodiment of the present invention will be described as follows. FIG. 9 is a side elevational view in longitudinal section for showing an inline type pump, FIG. 10 is a sectional view taken along an arrow line A—A in FIG. 9, and FIG. 11 is a side elevational view in longitudinal section to illustrate a part of a rotor.

In FIG. 9, reference numeral 101 denotes a motor. The motor 101 is comprised of a cylindrical stator 102, and a rotor 103. The stator 102 has a stator core 104 formed by laminating annular iron cores; a coil 105 wound around the stator core 104; and a resin layer 106 covering this coil 105 together with the end surface of the stator core 104.

The rotor 103 has an axial flow vane 108 having fixedly the rotating shaft 107 at its center; and magnetic poles 109 arranged at a part of the outer circumference of the axial flow vane 108. The axial flow vane 108 in this preferred embodiment is made such that a helical groove 111 is formed at the outer circumference of a column 110, and as shown in FIG. 11, a width (w) and a depth (h) of the helical groove 111 are approximately set to equal value.

To one end of the stator 102 is fixed a flange 112. This flange 112 has a dome-shaped supporting part 114 supporting the bearing 113; and an opening 115 which opens periphery of the supporting part 114, wherein a plurality of rectifying plates 116 are formed radially at the opening 115.

In addition, to the surface of the flange 112 is fixed a suction port member 118 having a suction port 117 for sucking the fluid. To the circumferential edge of the other end of the stator 102 is fixedly connected the circumferential edge of the cup-shaped discharging port member 120 having a discharging port 119, and a partition wall 121 is arranged inside the discharging port member 120. Although the partition wall 121 is integrally formed with the discharging port member 120, it may also be applicable that it is formed by a separate member and fixed to the discharging port member 120. A pressure chamber 122 is formed between the partition wall 121, the end portions of the stator 102 and the rotor 103, a second pressure chamber 123 is formed between the partition wall 121 and the discharging port 119. These pressure chambers 122, 123 are connected by a plurality of guide holes 124 formed at the outer circumference of the partition wall 121. As shown in FIG. 10, at the centers of these guide holes 124 are arranged ribs 125 connecting the inner circumferential surface of the discharging port member 120 with the outer circumferential edge of the partition wall 121. These ribs 125 are set such that an inclination angle of the axial flow vane 108 in respect to the rotating shaft 107 is defined to enable the flow of fluid circulating direction to be corrected to the axial flow direction.

Further, as shown in FIG. 9, at the central part of the partition wall 121 are formed a supporting part 127 supporting the outer circumference of the sliding bearing 126; and a leakage flow passage 128 communicating between the second pressure chamber 123 and the inner circumferential surface of the sliding bearing 126.

Then, the rotating shaft 107 of the rotor 103 is rotatably supported by the bearing 113 and the sliding bearing 126. A diameter of the recess (the bottom part of the helical groove 111 in this example) of the axial flow vane 108 having the minimum radius around the axis (the rotating center) of the rotor 103 is set to be a larger diameter than that of the supporting part 127.

With such an arrangement as above, when the suction port 117 is connected to the fluid supplying source, the discharging port 119 is connected to the fluid supplying location and an electrical current is flowed in the coil 105, the motor 101 is driven. That is, the rotor 103 having the axial flow vane 108 is rotated. With such an arrangement as above, the fluid is sucked at the suction port 117, its flow is rectified by the rectifying plates 116 formed at the opening part 115 of the flange 112, the fluid is forcedly fed to the pressure chamber 122 by the axial flow vane 108, and further the fluid is discharged out of the discharging port 119 from the guide holes 124 through the second pressure chamber 123. In this case, although the fluid is fed under rotation of the axial flow vane 108 while being circulated, the rotational kinetic energy is converted into a static pressure energy at the pressure chamber 122, so that the fluid can be efficiently fed out of the discharging port 119.

That is, a rotational speed of the fluid discharged out of the helical groove 111 becomes low as a rotational radius becomes an outer circumferential direction, and a difference in speed of the kinetic energy is converted into a pressure.

In addition, in the case of the preferred embodiment of the present invention, the central part of the partition wall 121 is provided with a sliding bearing 126 rotatably supporting the rotating shaft 107 of the rotor 103 with a predetermined clearance, the partition wall 121 is formed with the leakage flow passage 128 communicating between the second pressure chamber 123 and the inner circumferential surface of the sliding bearing 126, so that the fluid in the second pressure chamber 123 is present with a uniform pressure distribution between the rotating shaft 107 of the rotor 103 and the sliding bearing 126. Accordingly, it is possible to keep a superior lubrication of the rotating shaft 107 for a long period of time.

Further, in the case of the preferred embodiment of the present invention, a diameter of the recess of the axial flow vane 108 (in this example, the bottom part of the helical groove 111) where the radius with the axis of the rotor 103 as a center becomes a minimum value is set to a larger diameter than that of the supporting part 127, so that it is possible to easily guide the fluid toward the outside part of the pressure chamber 122 where the guide holes 124 are formed and further it is possible to reduce loss caused by striking action between the fluid fed by the axial flow vane 108 and the supporting part 127 supporting the sliding bearing 126.

Further, the recess part of the axial flow vane of which diameter is set to be larger than that of the supporting part 127 is not restricted to that of the aforesaid example. For example, as described in the gazette of Japanese Patent Laid-Open No. Hei 10-246193, many core pieces are laminated, thereby the recess includes such a recess as one in the axial flow vane having salient poles and a recess. In addition, in the case that either a screw or an axial flow vane called as an impellor having a plurality of inclined vanes is used, the root of the vane in respect to the rotating shaft is defined as a recess.

That is, increasing of a diameter of the recess of the axial flow vane more than the diameter of the supporting part 127 is, in other words, defining a size and shape of the axial flow vane in such a way that the fluid may easily flow toward the outside of the radial direction of the supporting part 127. The element satisfying this condition is the aforesaid axial flow vane 108. Application of the axial flow vane 108 enables loss caused by striking between the fed fluid and the supporting part 127 supporting the sliding bearing 126 to be reduced.

As shown in FIG. 11, the axial flow vane 108 is formed with a helical groove 111 at the outer circumference of the column 110. In this case, as the values of (w) and (h) are made as large as possible, the flow passage resistance is reduced and its efficiency is improved. However, when the value of (h) is kept constant, as the value of (w) is made as large as possible in such a way that a relation of w>h is attained, the laminated flow state is collapsed, a turbulent flow returned back to the suction side of the rear part in the rotating direction of the helical groove 111 is generated, whereby the efficiency is reduced. In turn, in the case of w<h, although the aforesaid turbulent flow is not generated, the flow passage resistance is produced to cause the efficiency to be reduced. However, in the preferred embodiment of the present invention, since the width (w) and the depth (h) of the helical groove 111 are approximately set to the same value, it is possible to feed the fluid more efficiently.

[Fifth Preferred Embodiment]

Figure 12:
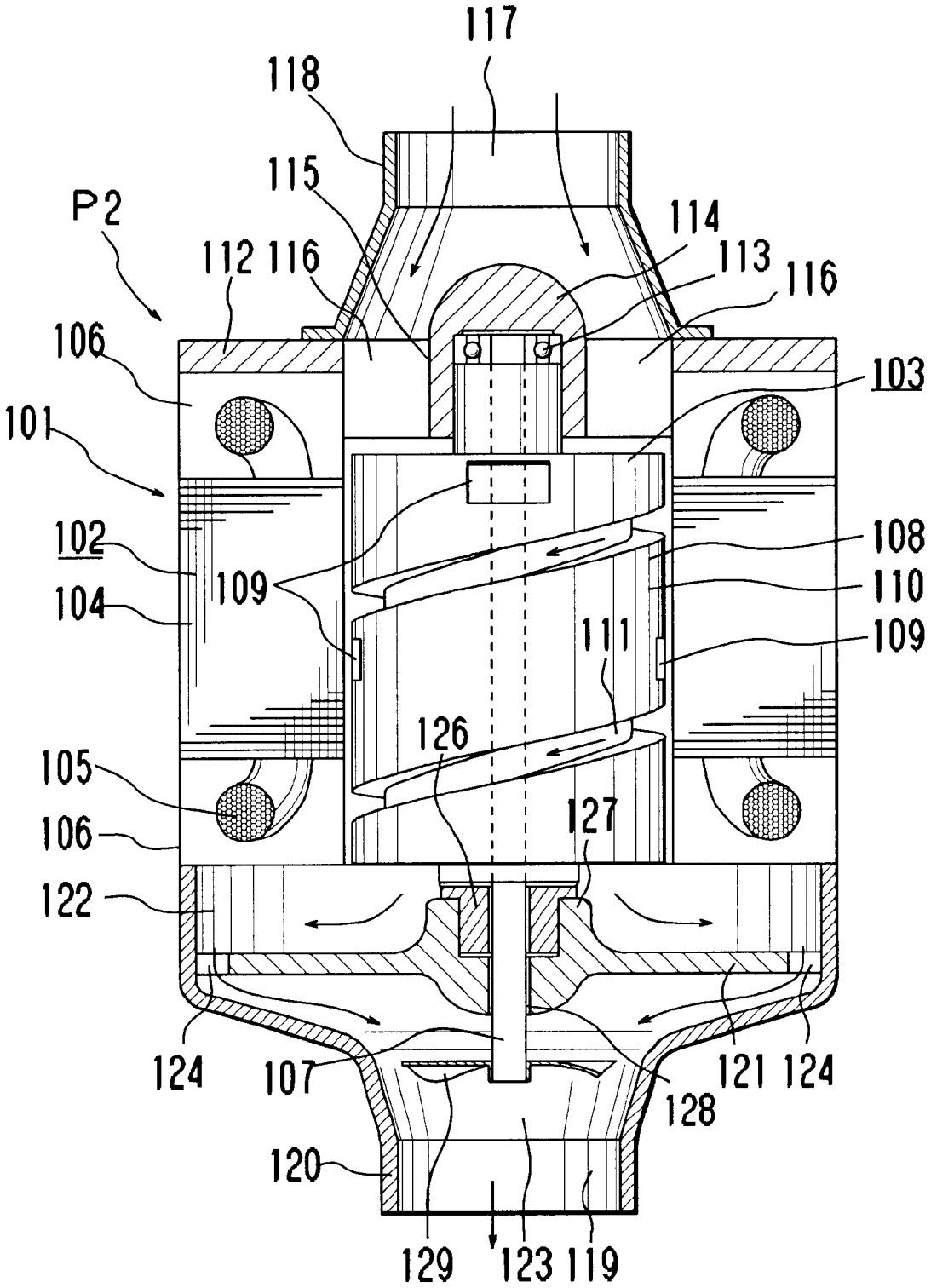
FIG. 12 is a side elevational view in longitudinal section for illustrating an inline type pump in a fifth preferred embodiment of the present invention.

Referring to FIG. 12, a fifth preferred embodiment of the present invention will be described. The same portions as that of the fourth preferred embodiment are denoted by the same reference symbols and their description will be eliminated. FIG. 12 is a side elevational view in longitudinal section for showing an inline type pump P2.

The inline type pump P2 in the preferred embodiment of the present invention is made such that a rotating shaft 107 of the rotor 103 is extended out to a second pressure chamber 123, and a second axial flow vane 129 is fixedly arranged at the extended portion. As the second axial flow vane 129, the axial flow impellor having a plurality of vanes is used.

With such an arrangement as above, it is possible to disperse the pressure and feed the fluid by the axial flow vane 108 arranged inside the stator 102 and the second axial flow vane 129 arranged at the second pressure chamber 123. In addition, power of the motor 101 may also be dispersed. In such an arrangement as above, when the rotor 103 is made to be small in size, reduced amount of fluid feeding performance of the axial flow vane 108 can be supplemented by the second axial flow vane 129. With this configuration, the fluid can be efficiently fed while satisfying setting of a small-sized formation of the motor 101.

[Sixth Preferred Embodiment]

Figure 13:
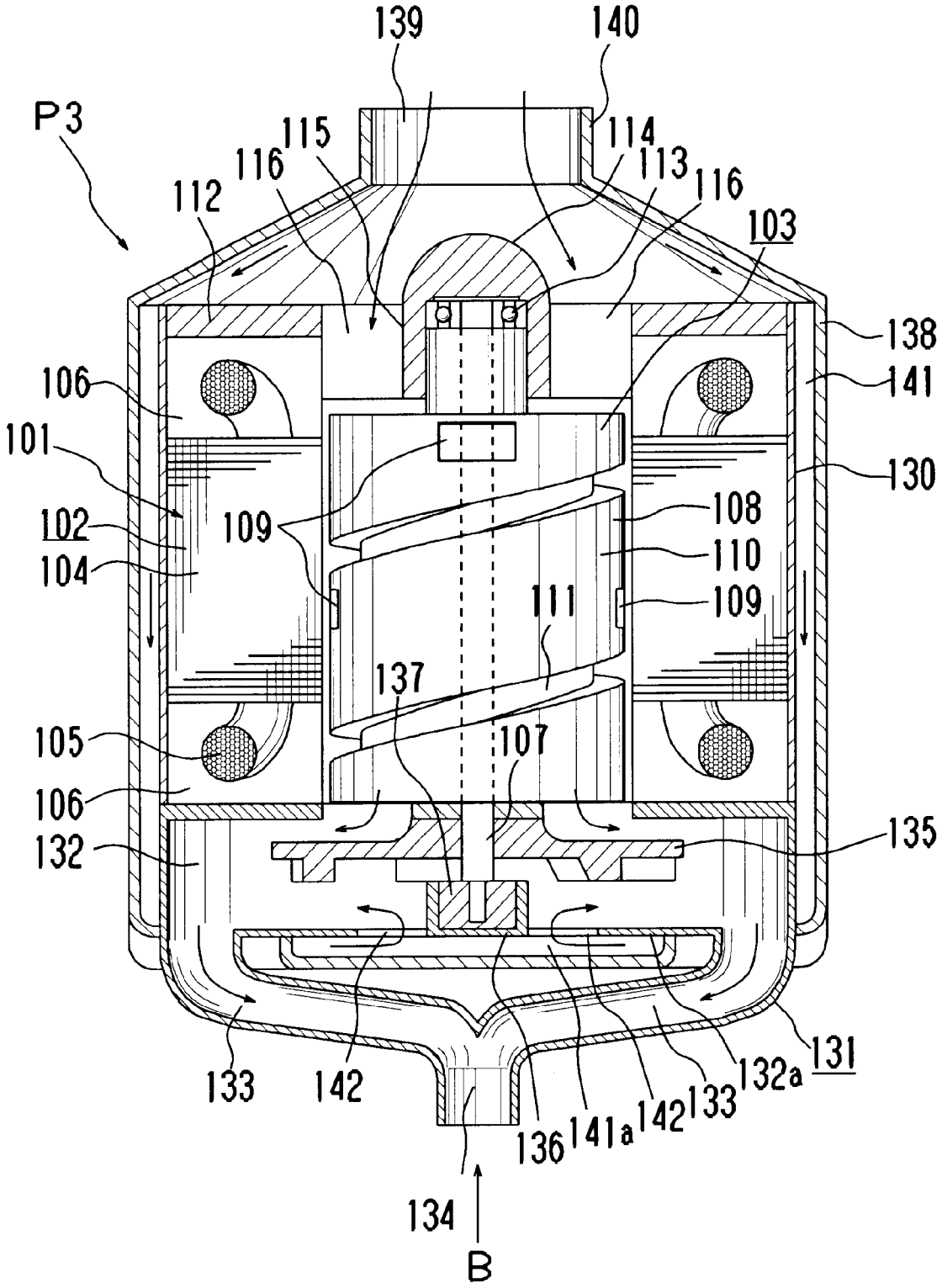
FIG. 13 is a side elevational view in longitudinal section for illustrating an inline type pump in a sixth preferred embodiment of the present invention.
Figure 14:
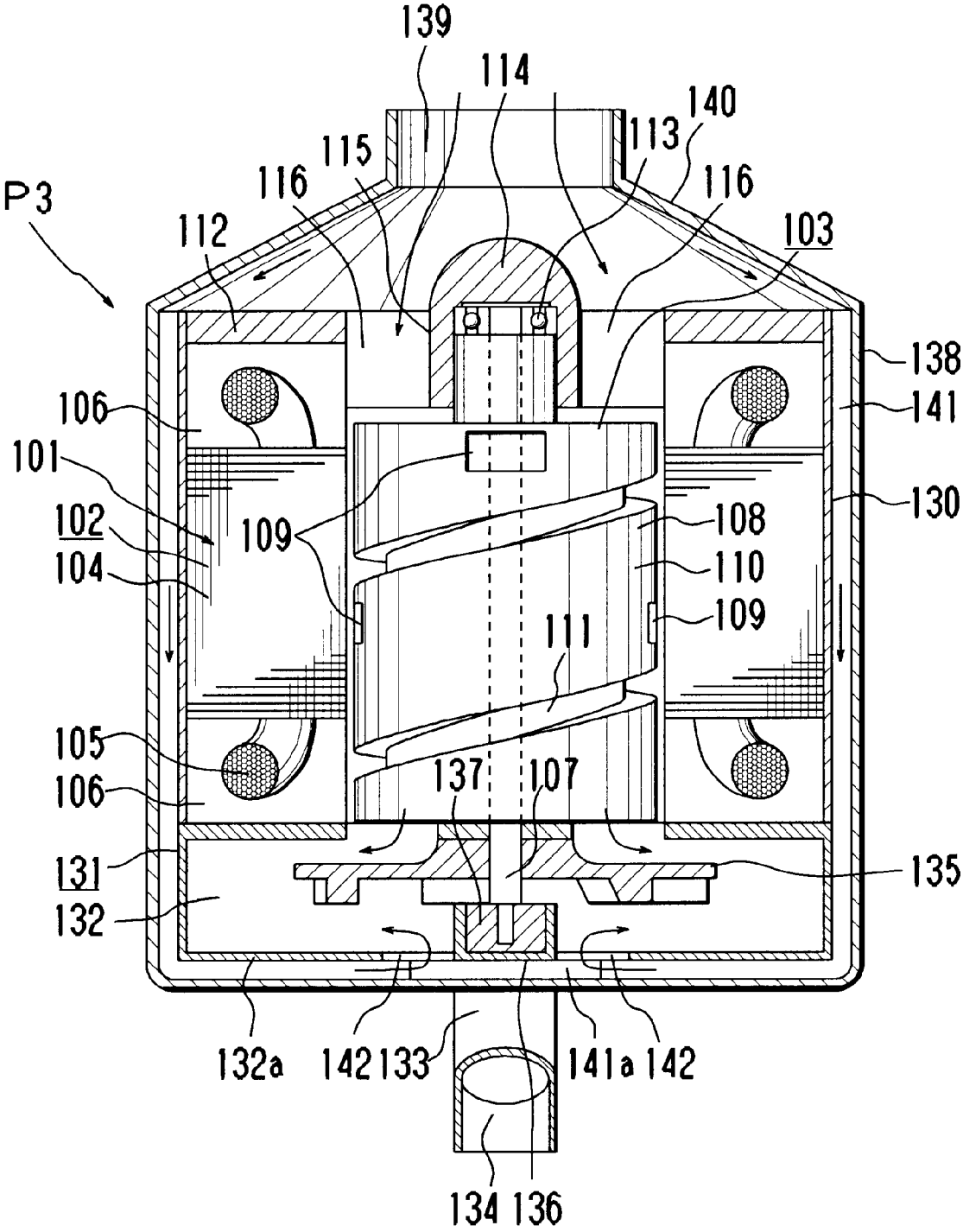
FIG. 14 is a side elevational view in longitudinal section for illustrating the inline type pump shown in FIG. 13 from a direction different by 90°.

Then, referring to FIGS. 13 to 15, a sixth preferred embodiment of the present invention will be described as follows. The same portions as that of the fourth preferred embodiment are denoted by the same reference symbols and their description will be eliminated. FIG. 13 is a side elevational view in longitudinal section for showing an inline type pump P3, and FIG. 14 is a side elevational view in longitudinal section for showing the inline type pump P3 shown in FIG. 13 as viewed from a different direction by 90°.

The motor 101 in the preferred embodiment of the present invention is provided with a cylinder 130 covering an outer circumference of the stator 102. To one end of the motor 101 (the lower end as viewed in FIGS. 13 and 14) is fixed a connecting port member 131. This connecting port member 131 has a pressure chamber 132 in which a rotating kinetic energy of the fluid sucked by the axial flow vane 108 included in the rotor 103 is changed into a static pressure energy; and two pipe-like guide flow passages 133 projected downwardly from the positions spaced apart by 180° at an outer circumference of the pressure chamber 132. These guide flow passages 133 are merged on an extended line of the center of the rotor 103, and then a discharging port 134 is formed at the forward part of the merging point. The pressure chamber 132 is provided with a centrifugal vane 135 fixed to a lower end of the rotating shaft 107 of the rotor 103. One end of the rotating shaft 107 passing through the centrifugal vane 135 is rotatably supported by a bearing 137 supported by a supporting section 136 arranged at the center of the connecting port member 131.

Reference numeral 138 denotes a suction case formed into a container shape. The opening surface of the suction case 138 is covered with the suction port member 140 formed with a suction port 139 at its central part. The motor 101 and a part of the connecting port member 131 are stored in the suction case 138.

Figure 15:
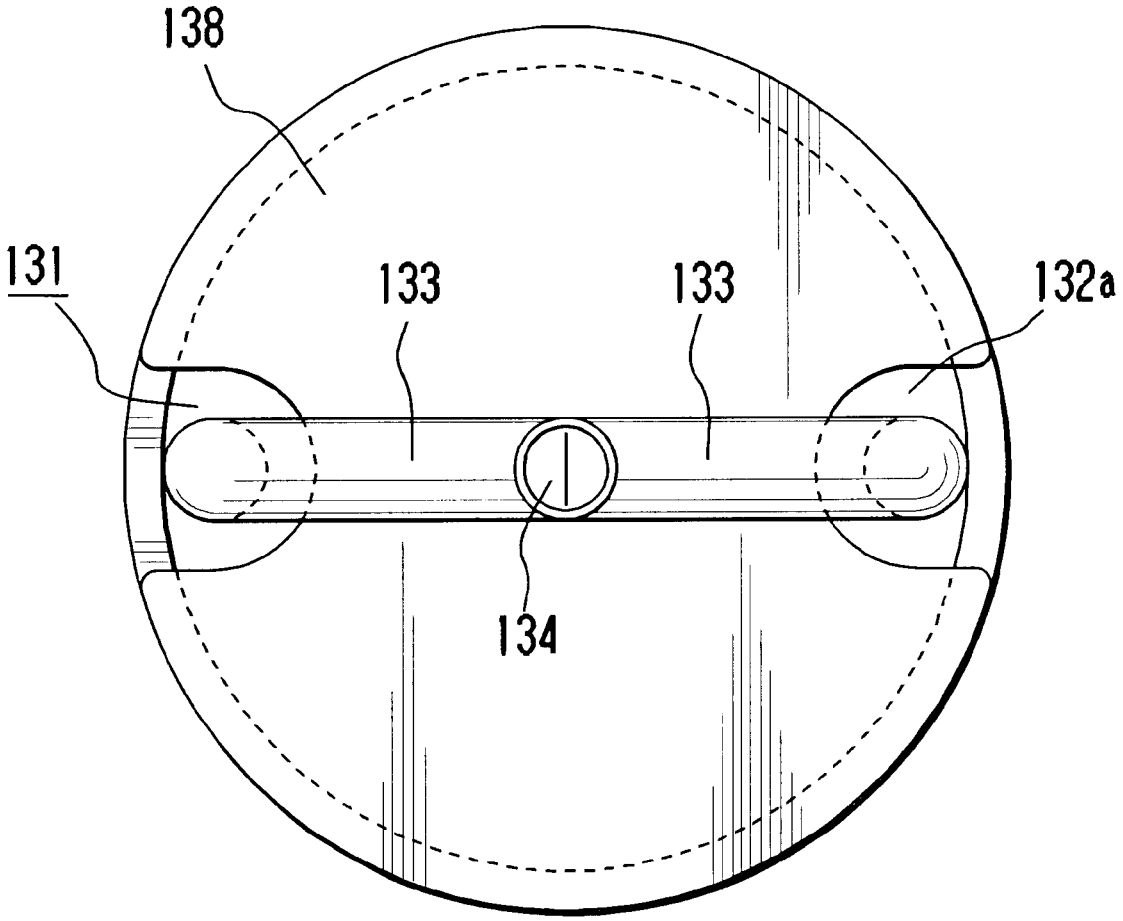
FIG. 15 is a bottom view for showing the inline type pump as viewed from the direction of arrow line B in FIG. 13.

FIG. 15 is a bottom view for showing an inline type pump P3 as viewed from a direction of an arrow B in FIG. 13. In the figure, reference numeral 132*a* denotes a bottom surface of the pressure chamber 132. This bottom surface 132*a* is defined into a disc-like shape in compliance with the bottom surface of the cylindrical motor 101. However, only the guide flow passage 133 is formed into such a size and shape as one to be exposed below the suction case 138.

A suction flow passage 141 for sucking fluid is formed between the outer periphery of the motor 101, the outer periphery of the connecting port member 131 and the suction case 138. The suction flow passage 141 defines a flow passage such that, as shown in FIGS. 13 and 14 with an arrow, the fluid sucked through the suction port 139 is guided to the pressure chamber 132 through the outer circumferential part of the stator 102 and further fed toward the surface opposite to the axial flow vane 108 of the centrifugal vane 135. That is, as shown in FIG. 13, the suction flow passage 141 is provided with a connecting part 141*a* connected to the two connecting holes 142 formed at a symmetrical position of the bottom part of the pressure chamber 132 of the connecting port member 131 with the center of the rotating shaft 107 being placed therebetween. As apparent in FIG. 13, the connecting part 141*a* is arranged to pass between the bottom surface 132*a* of the pressure chamber 132 of the connecting port member 131 and the guide flow passage 133.

With such an arrangement as above, when the rotor 103 is rotated, the fluid sucked from the suction port 139 is rectified in its flow by the rectifying plates 116 formed at the opening part 115 of the flange 112, forcedly fed to the pressure chamber 132 by the axial flow vane 108, the rotating kinetic energy is converted into a static pressure energy at the pressure chamber 132 and at the same time the fluid passes through the suction flow passage 141 of another system and is guided to the pressure chamber 132. The fluid passed through the flow passages in the two systems and guided to the pressure chamber 132 passes through the guide flow passage 133 under rotation of the centrifugal vane 135 and is discharged out of the discharging port 134. With such an arrangement as above, it is possible to feed fluid efficiently.

In this case, the centrifugal vane 135 rotated integrally with the axial flow vane 108 receives at an upper surface a pressure of the fluid transferred by the axial flow vane 108, and receives at a lower surface a pressure of the fluid fed through the connecting part 14*a* of the suction flow passage 141. That is, since pressures in both directions may act in the mutual canceling direction, it is possible to reduce a thrust load applied to the rotor 103 by fluid.

Further, almost of the suction flow passage 141 formed between the motor 101 and the outer circumference of the pressure chamber 132 has an equal flow passage sectional area with an annular shape, wherein the connecting part 141*a* forming a part of the suction flow passage 141 and the guide flow passage 133 of the connecting port member 131 are formed to have a symmetrical shape and size at the symmetrical position with the axis of the rotating shaft 107 of the rotor 103 being applied as a center. That is, the suction flow passage 141 and the guide flow passage 133 are defined such that energies of the flowing fluid may become substantially equal at the symmetrical positions with the axis of the rotor 103 being applied as a center. Accordingly, it is possible to reduce a load in a radial direction applied to the rotor 103. With such an arrangement as above, it is possible to extend a life of each of the bearing 113, bearing 137 and rotating shaft 107 and to perform a smooth rotation of the motor 101 for a long period of time.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

The present application is based on Japanese Priority Documents 2000-022836 filed on Jan. 31, 2000 and 2000-023614 filed on Feb. 1, 2000, the content of which are incorporated herein by reference.

What is claimed is:

1. An inline type pump comprising:

a cylindrical stator arranged between a suction port and a discharging port;

a rotor rotatably arranged inside the stator;

an axial flow vane integrally arranged with the rotor for axially feeding fluid sucked from the suction port toward the discharging port; and a pressure chamber for converting a rotational kinetic energy of the fluid sent toward the discharging port by the axial flow vane of the rotor into a static pressure energy, wherein the rotor includes a plurality of salient poles at its outer diameter and is formed with an axial communicated helical recess at its outer circumference to constitute the axial flow vane, and wherein the pressure chamber is a space having a larger inner diameter than an inner diameter of at least the discharging port in a direction crossing at a right angle with a rotating shaft of the rotor.

2. An inline type pump according to claim 1, wherein the discharging port is communicated from the inner diameter of the space with an outside.

3. An inline type pump according to claim 1, wherein a part of the rotor is arranged so as to project up to the pressure chamber.

4. An inline type pump according to claim 1, further comprising a flow rectifying part for changing an advancing direction of the fluid fed by the axial flow vane of the rotor toward the discharging port into a direction crossing at a right angle with a rotating shaft of the rotor.

5. An inline type pump according to claim 1, further comprising centrifugal vanes arranged at the pressure chamber for expanding a rotating radius of fluid in a direction of the outer circumference of the rotor by rotating integrally with the rotor.

6. An inline type pump according to claim 5, wherein the centrifugal vanes include blades applying a centrifugal energy to fluid.

7. An inline type pump according to claim 1, further comprising:

a second pressure chamber arranged between the pressure chamber and the discharging port and divided from the pressure chamber with a partition wall; and guide holes arranged at an outer circumference of the partition wall and connecting between the pressure chamber and the second pressure chamber.

8. An inline type pump according to claim 7, wherein a center of the partition wall is provided with a sliding bearing for rotatably supporting the rotating shaft of the rotor with a predetermined clearance, and the partition wall is formed with a leakage flow passage communicating between the second pressure chamber and the inner circumferential surface of the sliding bearing.

9. An inline type pump according to claim 7, wherein the second pressure chamber is provided with a second axial flow vane rotated integrally with the rotor.

10. An inline type pump according to claim 7, wherein a diameter of a recess of the axial flow vane where a radius around the center of axis of the rotor is minimum is set to be larger diameter than a diameter of the supporting part formed at the partition wall for supporting the sliding bearing.

11. An inline type pump according to claim 7, 8, 9 or 10, wherein the axial flow vane is formed with a helical groove at an outer circumference of a column, values of a width and a depth of the helical groove are set to substantial equal to each other.

12. An inline type pump according to claim 1, further comprising:

centrifugal vanes arranged in the pressure chamber and integrally rotated with the rotor;

a suction flow passage whose path is defined so as to guide the fluid sucked from the suction port to the pressure chamber through an outer circumference part of the stator and to feed it toward the surface of the centrifugal vanes opposite to the axial flow vane; and a guiding flow passage for guiding fluid in the pressure chamber from the outer circumference of the pressure chamber to the discharging port under rotation of the centrifugal vanes.

13. An inline type pump according to claim 12, wherein the connecting part with the pressure chamber in the guide flow passage is defined such that energies of flowing fluid may become substantially equal at symmetrical positions with the axis of the rotor being applied as a center.

* * * * *